US006756748B2

(12) United States Patent
Bae et al.

(10) Patent No.: US 6,756,748 B2
(45) Date of Patent: Jun. 29, 2004

(54) ELECTRON GUN FOR COLOR CATHODE RAY TUBE

(75) Inventors: Min-Cheol Bae, Suwon (KR); Young-Gon Hong, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/134,699

(22) Filed: Apr. 30, 2002

(65) Prior Publication Data

US 2002/0163291 A1 Nov. 7, 2002

(30) Foreign Application Priority Data

May 4, 2001 (KR) ..... 2001-24375

(51) Int. Cl.[7] ..... H01J 29/58

(52) U.S. Cl. ..... 315/382; 315/15; 313/412; 313/414

(58) Field of Search ..... 315/368.15, 368.16, 315/369, 15, 382; 313/412, 414, 428, 432, 441

(56) References Cited

U.S. PATENT DOCUMENTS 4,701,677 A 10/1987 Ashizaki et al. ..... 315/582
4,764,704 A 8/1988 New et al. ..... 313/414
4,814,670 A 3/1989 Suzuki et al. ..... 315/15
4,877,998 A * 10/1989 Maninger et al. ..... 315/15
5,027,043 A 6/1991 Chen et al. ..... 315/368
5,300,855 A * 4/1994 Kweon ..... 313/414
5,367,230 A * 11/1994 Iguchi et al. ..... 315/368.15
6,051,919 A 4/2000 Shirai et al. ..... 313/414
6,456,017 B1 * 9/2002 Bae et al. ..... 315/369
6,498,427 B1 * 12/2002 Song et al. ..... 313/414

* cited by examiner

*Primary Examiner*—Don Wong
*Assistant Examiner*—Jimmy Vu
(74) *Attorney, Agent, or Firm*—Robert E. Bushnell, Esq.

(57) ABSTRACT

An electron gun for a color CRT includes a triode unit including a cathode, a control electrode, and a screen electrode for emitting an electron beam, first and second auxiliary focusing electrodes sequentially installed coaxially with the triode unit, for forming auxiliary lenses, first and second focusing electrodes installed coaxially with the first and second electrodes, for forming a quadrupole lens, and a final acceleration electrode installed close to the second focusing electrode, for forming a main lens. In the electron gun, protruding portions having flat surfaces corresponding to opposite surfaces of the first and second focusing electrodes are formed on at least one of the opposite surfaces of the first and second focusing electrodes to change the profile of the electron beam by applying a dynamic focus voltage to the edge of electron beam passing holes formed in the opposite surfaces.

19 Claims, 7 Drawing Sheets

ELECTRON GUN FOR COLOR CATHODE RAY TUBE

CLAIM OF PRIORITY

This application makes reference to, incorporates the same herein, and claims all benefits accruing under 35 U.S.C. § 119 from my application entitled *ELECTRON GUN FOR COLOR CATHODE RAY TUBE* earlier filed with the Korean Industrial Property Office on May 4, 2001 and there duly assigned Serial No. 24375/2001.

BACKGROUND OF THE INVENTION

1. Field of the Invention

The present invention relates to an electron gun for a color cathode ray tube (CRT), and more particularly, to an electron gun for a color CRT having improved electrodes arranged inline and forming at least one quadrupole lens.

2. Description of the Related Art

A typical electron gun for a color CRT is installed at a neck portion of the CRT to emit an electron beam. The performance of the color CRT depends on how the electron beam emitted from the electron gun lands on a fluorescent film. Accordingly, various types of electron guns have been developed to improve a focus feature and reduce aberration of an electron lens so that the electron beam emitted from the electron gun can accurately land on a fluorescent point of the fluorescent film.

In particular, in order to reduce the total length of a CRT, the diffraction angle of the CRT is increased so that the length of the electron gun is reduced. In this case, since the focusing length of an electron beam landing on the peripheral portion of the fluorescent film is relatively greater than that of an electron beam landing on the central portion of the fluorescent film, the focus feature of the electron beam at the peripheral portion of a screen deteriorates.

Also, as the deflection angle increases, the incident angle of an electron beam with respect to the fluorescent film decreases. Accordingly, the amount of distortion of an electron beam increases exponentially so that the diameter of the electron beam landing on the fluorescent film increases. A self-convergence type inline color CRT includes a deflection yoke forming a non-uniform magnetic field to deflect the electron beam emitted from the electron gun. The electron beams emitted from the electron gun are focused by means of a main lens formed in the electron beam, and converged throughout the entire area of a screen by the non-uniform magnetic field formed of a pincushion type horizontal deflection magnetic filed and a barrel type vertical deflection magnetic field by a deflection magnetic field.

The side electron beams of three electron beams passing through the non-uniform magnetic field and arranged inline is distorted relatively greater than the central electron beam. Thus, it is advantageous to the focus feature to make a correction force of the side electron beams greater than that of the central electron beam.

To adjust the profile and focus length of the electron beams, conventional electron guns adopt quadrupole lenses. The function of a quadrupole lens is as follows.

When electron beams emitted from a triode unit of an electron gun pass a pre-focus point and finally arrive at a quadrupole lens, a dynamic voltage applied to electrodes constituting the quadrupole lens is increased. Then, electrons forming the electron beams receive forces in directions in which electrons are divergent vertically and condensed horizontally, by an electric field forming the quadrupole lens. Thus, when the electron beams are deflected toward the peripheral portion of a screen, the distortion of the electron beam due to the deflective magnetic field, the incident angle of the electron beam, and the curvature of a screen surface is compensated.

However, during the increase of the dynamic voltage, a degree of focal length and astigmatism among the three inline electron beams has a difference of a degree of adjustment due to a difference in diameter of a large diameter lens, and the ratio of the horizontal and vertical lengths of the diameter.

An electron gun to correct astigmatism of an electron beam deflected toward the peripheral portion of a screen is disclosed in U.S. Pat. No. 4,701,677 for *Color Cathode Ray Tube Apparatus* by Ashizaki et al. and U.S. Pat. No. 4,814,670 for *Cathode Ray Tube Apparatus Having Focusing Grids with Horizontally and Vertically Oblong Through Holes* by Suzuki, et al.

In the electron gun disclosed in U.S. Pat. No. 4,814,670, to decrease astigmatism due to the deflection of an electron beam, a focus electrode is cut into two parts. A vertically elongated electron beam passing hole is formed in one of the cut electrode while a horizontally elongated electron beam passing hole is formed in the corresponding other cut electrode.

Another example of the conventional electron gun is disclosed in U.S. Pat. No. 5,027,043 for *Electron Gun System with Dynamic Convergence Control*. The electron gun is provided with means for converging the electron beam from a linear path. A quadrupole lens for correcting known a aberration by a self-convergence type deflection yoke is used as such means. The quadrupole lens means has a structure of applying different voltages to electrodes where a vertically elongated electron beam passing hole or a horizontally elongated electron beam passing hole are formed. Thus, the electron gun can correctly focus the three inline electron beams and correct a profile by vertical and horizontal deflective magnetic fields for the deflection of an electron beam.

As a color CRT has a wide deflection angle and is made flat, the difference between the focal lengths at the center of a screen and the peripheral portion thereof increases and the astigmatism due to the deflection yoke becomes greater. Therefore, the electron gun needs a strong astigmatism correction force and focal length correction force.

For the strong astigmatism correction force, since the electric potential difference between electrodes forming a quadruple lens must be wide and the focal length correction force must be large, a high voltage is needed at the peripheral portion of the screen. However, the high voltage causes problems in the reliability of a circuit and the withstand voltage between electrodes of an electron gun. Also, an electron beam is incident on the peripheral portion of a screen, the incident angle of the beam decreases in the horizontal direction and increases in the vertical direction by one of the functions of a quadrupole lens close to a main lens, that is, a function of making an electron beam condensed in the horizontal direction and diverged in the vertical direction. Thus, it is a problem that a horizontal diameter increases at the peripheral portion of a screen.

Meanwhile, astigmatism due to the deflection of the electron beam deteriorates as the deflection angle of the electron beam due to the deflection yoke and a convergence feature is deteriorated. To overcome the above problems, a color CRT with a quadrupole lens is disclosed in U.S. Pat.

No. 6,051,919 for *Color Cathode Ray Tube with Electrostatic Quadrupole Lens* by Shirai et al.

In the above color CRT, the length of a plate of plate electrodes formed on the opposite surfaces of electrodes forming a quadrupole lens of an electron gun is formed such that the plate of the central electron beam is longer than that of the side electron beams. Thus, the central electron beam is strongly corrected to be focused for the correction of convergence and astigmatism at the peripheral portion of a screen.

However, in the CRT having the above quadrupole lens, as the deflection angle of the electron beam increases, a dynamic voltage applied to the electrodes forming the quadrupole lens increases at the peripheral portion of a screen. As the dynamic voltage increases, the focus feature is deteriorated at the peripheral portion of a screen due to the difference in the astigmatism correction effect at the peripheral portion of a screen between the central electron beam and the side electron beams which are arranged inline.

In particular, the above phenomenon becomes serious in an electron gun adopting a large diametric main lens. That is, when a dynamic voltage in synchronism with a deflection signal is applied to a large diametric electrode, the rate of a change of an electrostatic lens in vertical and horizontal directions of the central electron beam passing hole is greater than that of the side electron beam passing holes. The above phenomenon occurs since, in an area where the central electron beam passes, equipotential lines are gradually distributed in the horizontal direction compared to those in the vertical direction so that the effective diameter of the electrostatic lens is greater than that in the vertical direction and the rate of change in the vertical direction is greater than that in the horizontal direction during a change in strength of the main lens due to a change in the dynamic voltage.

However, since the side electron beams are located at the lateral side of the large diameter, during the change of a dynamic voltage, the effect of the change of equipotential lines in the horizontal direction is greater than the central portion. Accordingly, as the shape of the electron beam simultaneously changes in the horizontal direction, the rate of vertical elongation of an electron beam is less than that in the vertical direction. Thus, the dynamic voltage to deflect the side electron beams toward the peripheral portion of a screen should be higher than the dynamic voltage to deflect the central electron beam.

Another example of the conventional electron gun for color CRT is disclosed in U.S. Pat. No. 4,764,704 for *Color Cathode-ray Tube Having a Three-lens Electron Gun* by New et al. In the electron gun, a burring portion formed at two electrodes forming a quadrupole lens is cut into upper and lower portions and left and right portions and the cut portions are combined not to contact each other. Thus, a non-circularity of an electric field is corrected and the performance of the quadrupole lens according to the electron beam passing hole is maximized. However, it is not easy to form a lengthy burring portion of the electrodes forming the quadrupole lens of the electron gun. Also, reliability in processing according to the severance of the burring portion is low.

SUMMARY OF THE INVENTION

It is therefore an object of the present invention to provide an electron gun for a color CRT which can uniformly form an electron beam spot throughout the entire fluorescent film by improving a focus feature and correcting astigmatism due to a deflection yoke of three electron beams landing on the peripheral portion of the fluorescent film according to an increase of a deflection angle.

To achieve the above and other objects, there is provided an electron gun for a color CRT including a triode unit including a cathode, a control electrode, and a screen electrode for emitting an electron beam, and first and second focusing electrodes, installed coaxially with the triode unit, for forming at least one quadrupole lens, wherein protruding portions having flat surfaces corresponding to opposite surfaces of the first and second focusing electrodes are formed at least one of the opposite surfaces of the first and second focusing electrodes to change the profile of the electron beam by applying a dynamic focus voltage to the edge of electron beam passing holes formed in the opposite surfaces.

It is preferred in the present invention that vertically elongated electron beam passing holes are formed in the first focusing electrode and horizontally elongated electron beam passing holes are formed in the second focusing electrode, first and second protruding portions are formed at the horizontally opposite sides of each of the vertically elongated electron beam passing holes, and third and fourth protruding portions are formed at the vertically opposite sides of each of the horizontally elongated electron beam passing holes, and first and second flat surfaces are formed at the first and second protruding portions, respectively, and third and fourth flat surfaces are formed at the third and fourth protruding portions, respectively, thus forming a quadruple lens for changing the profile of an electron beam when a dynamic focus voltage is applied.

To further achieve the above and other objects, there is provided an electron gun for a color CRT including a triode unit having a cathode, a control electrode, and a screen electrode for emitting an electron beam, first and second auxiliary focusing electrodes sequentially installed coaxially with the triode unit, for forming auxiliary lenses, first and second focusing electrodes installed coaxially with the first and second electrodes, for forming a quadrupole lens, and a final acceleration electrode installed close to the second focusing electrode, for forming a main lens, wherein protruding portions having flat surfaces corresponding to opposite surfaces of the first and second focusing electrodes are formed at least one of the opposite surfaces of the first and second focusing electrodes to change the profile of the electron beam by applying a dynamic focus voltage to the edge of electron beam passing holes formed in the opposite surfaces.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Turning now to the drawings, an electron gun according to the present invention adopts a large diametric lens through which three electron beams pass in common. When the three electron beams are deflected by a deflection yoke, the profile of an electron beam is changed by varying a condensing force and a diverging force in the horizontal and vertical directions of a quadrupole lens acting on the three electron beams. Thus, an effect of correcting deflection astigmatism according to a non-uniform magnetic field of the deflection yoke is improved and adjustment of convergence according to a change of a dynamic focus voltage is easy. An electron gun according to a first preferred embodiment of the present invention is shown in FIG. 1.

Figure 1:
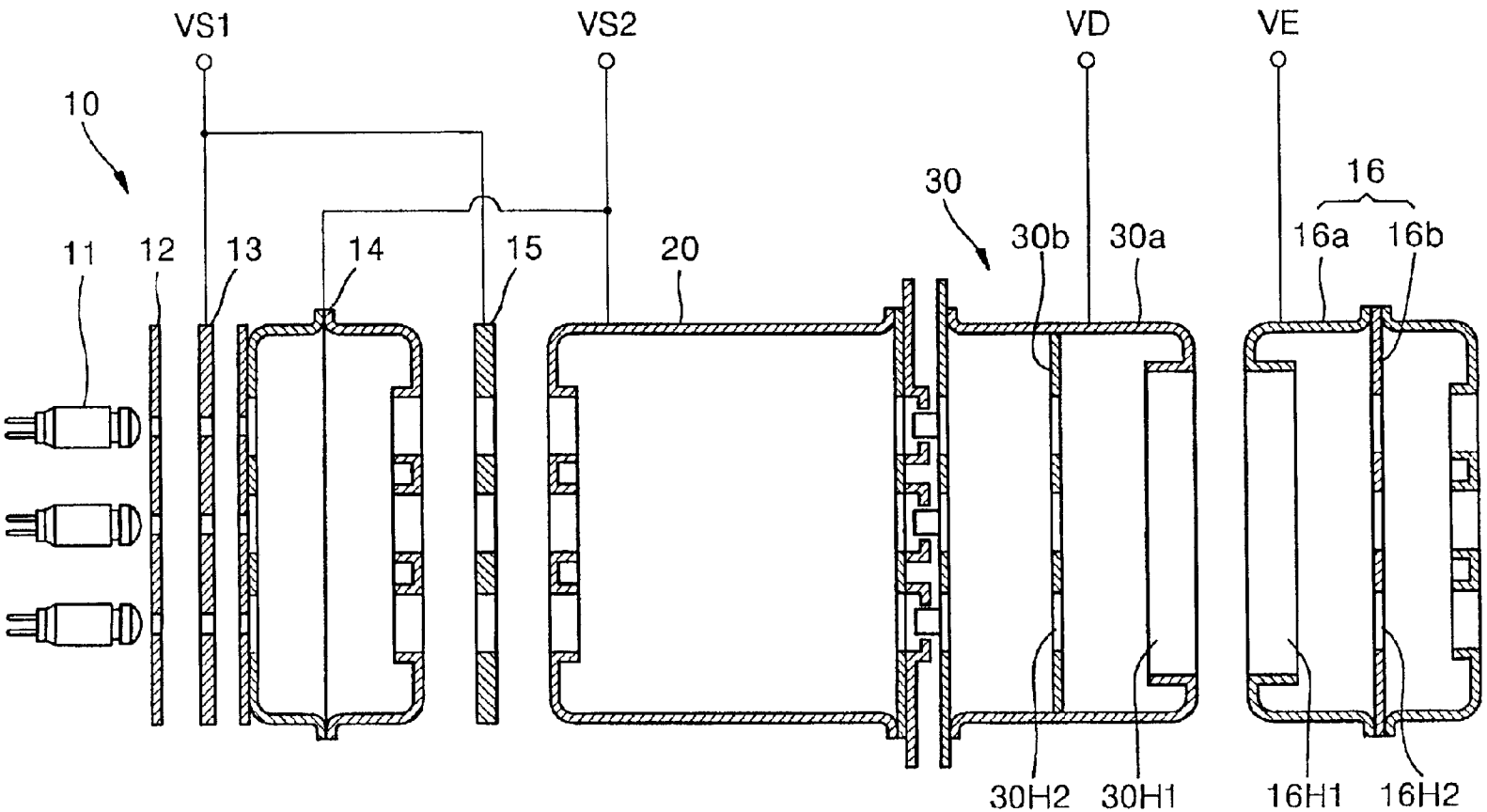
FIG. 1 is a view showing an electron gun for a color CRT according to the present invention.

Referring to FIG. 1, an electron gun 10 includes a triode portion formed of a cathode 11 which is an electron beam emitting source, a control electrode 12, and a screen electrode 13, first and second auxiliary focusing electrodes 14 and 15, which are sequentially installed coaxially with the triode portion, for preliminarily focusing and accelerating electron beams, first and second focusing electrodes 20 and 30 forming at least one quadrupole lens, and a final focusing (acceleration) electrode 16 installed close to the second focusing electrode 30 to form a large diametric main lens through which the three electron beams pass in common.

One or three electron beam passing holes are formed at each electrode forming the electron gun 10. In particular, each of an exit side surface of the second focusing electrode 30 and an incident side surface of the final focusing electrode 16 forming the large diametric main lens is formed of an outer electrode member 30*a* (16*a*) and an inner electrode member 30*b* (16*b*). The outer electrode member 30*a* (16*a*) has a large diametric electron beam passing hole 30H1 (16H1) through which three electron beams pass in common. The inner electrode member 30*b* (16*b*) has a plate shape and is installed inside the outer electrode member 30*a* (16*a*), in which three electron beam passing holes 30H2 (16H2) are independently formed.

Meanwhile, a correction unit formed of protruding portions having flat surfaces for correcting the profile of an electron beam by differentiating horizontal and vertical diverging forces of the quadrupole lens formed by the electron beam passing holes formed on the opposite surfaces of the first and second focusing electrodes 20 and 30, is provided.

Hereinafter, examples of correction units according to preferred embodiments of the present invention are described with reference to the attached drawings.

Figure 2:
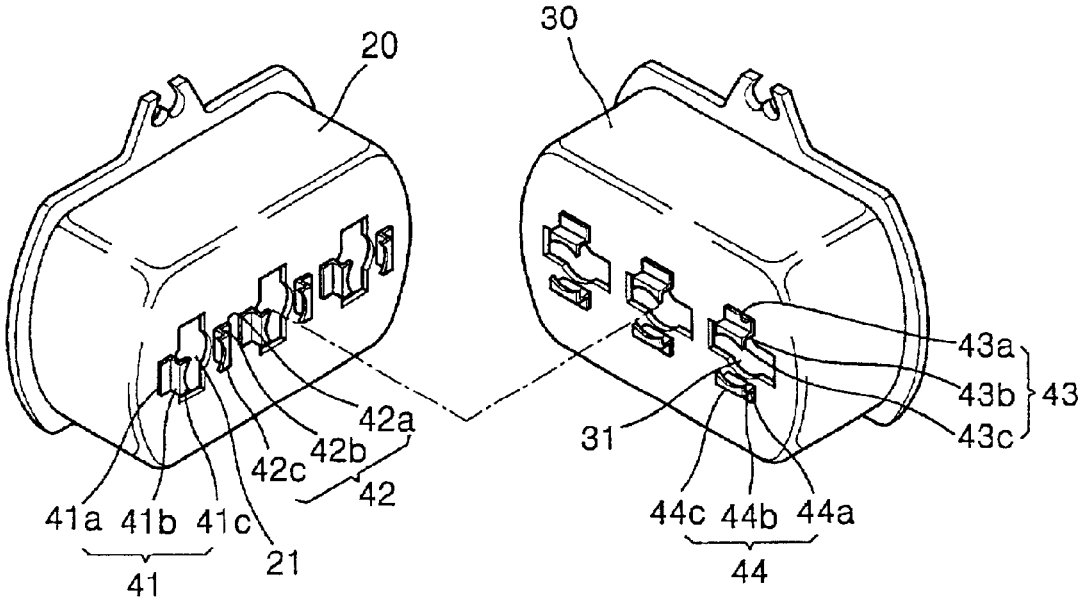
FIG. 2 is a perspective view showing a first focusing electrode and a second focusing electrode, which are separated, according to a first preferred embodiment of the present invention.
Figure 3:
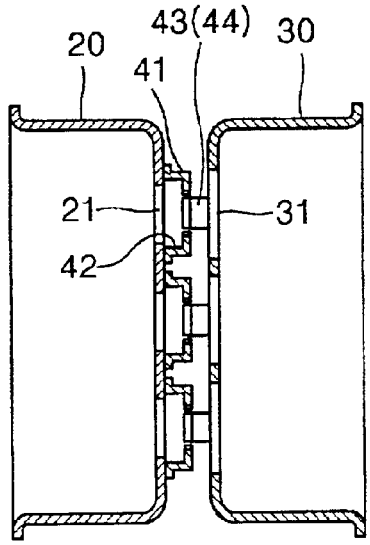
FIG. 3 is a sectional view showing the state in which the first and second focusing electrodes shown in FIG. 2 are combined.

Referring to FIGS. 2 and 3, a correction unit according to a first preferred embodiment of the present invention includes first and second protruding portions 41 and 42, and third and fourth protruding portions 43 and 44. The first and second protruding portions 41 and 42 are installed in the horizontal direction at the left and right sides of each vertically elongated electron beam passing hole 21 for forming a quadrupole lens at the exit side surface of the first focusing electrode 20. The third and fourth protruding portions 43 and 44 are formed in the vertical direction at the upper and lower sides of the horizontally elongated electron beam passing hole 31 formed in the second focusing electrode 30.

The first, second, third, and fourth protruding portions 41, 42, 43, and 44 are respectively formed by bending a plate shaped member to have a crank shape and include base portions 41*a*, 42*a*, 43*a*, and 44*a* combined at a corresponding surface of the first focusing electrode 20 or the second focusing electrode 30, extending portions 41*b*, 42*b*, 43*b*, and 44*b* respectively extending from the base 41*a*, 42*a*, 43*a*, and 44*a*, and flat surfaces 41*c*, 42*c*, 43*c*, and 44*c* respectively extending from the extending portions 41*b*, 42*b*, 43*b*, and 44*b* parallel to the opposite surfaces of the first and second focusing electrodes 20 and 30, that is, the exit side surface and the incident side surface. The extending portions 41*b*, 42*b*, 43*b*, and 44*b* connecting the base portions 41*a*, 42*a*, 43*a*, and 44*a* and the flat surfaces 41*c*, 42*c*, 43*c*, and 44*c* are formed perpendicularly or at a predetermined angle. The flat surfaces 41*c*, 42*c*, 43*c*, and 44*c* of the protruding portions 41, 42, 43, and 44 do not contact one another as shown in FIG. 3. The end portion of each of the flat surfaces 41*c*, 42*c*, 43*c*, and 44*c* is formed to be circular arc, oval arc, or polygonal arc. The protruding portions can be formed by cutting the first and second focusing electrodes 20 and 30 within a range of not interfering formation of a quadrupole lens.

Figure 4:
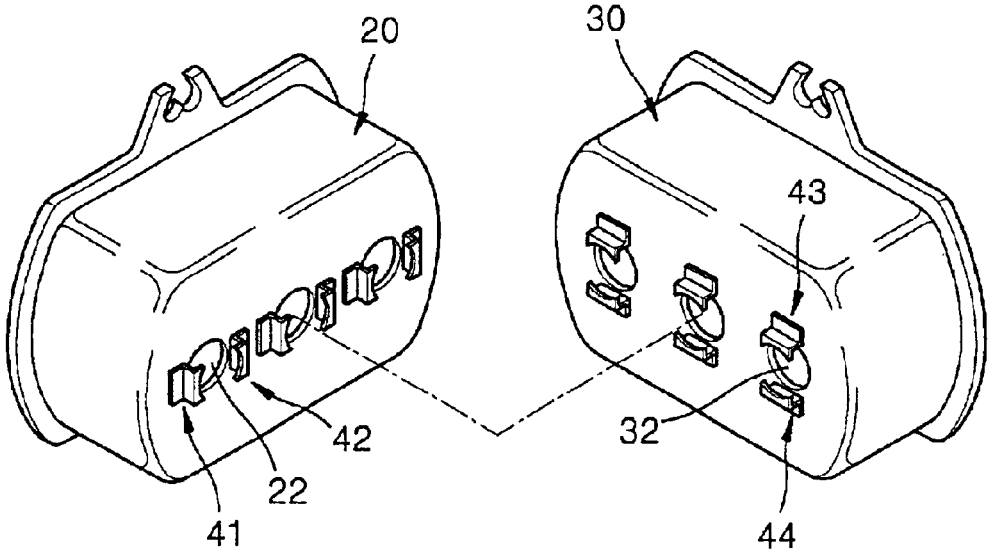
FIG. 4 is a perspective view showing a first focusing electrode and a second focusing electrode, which are separated, according to a second preferred embodiment of the present invention.
Figure 5:
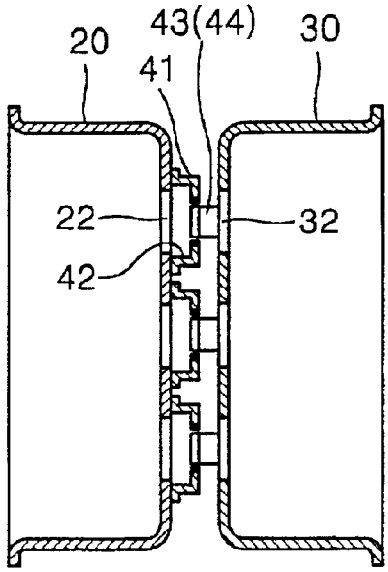
FIG. 5 is a sectional view showing the state in which the first and second focusing electrodes shown in FIG. 4 are combined.

Referring to FIGS. 4 and 5, in a correction unit according to a second preferred embodiment of the present invention, electron beam passing holes 22 and 32 are formed in the first and second focusing electrodes 20 and 30 to have circular shapes so that a quadrupole lens can be formed by the first, second, third, and fourth protruding portions 41, 42, 43 and 44.

Figure 6:
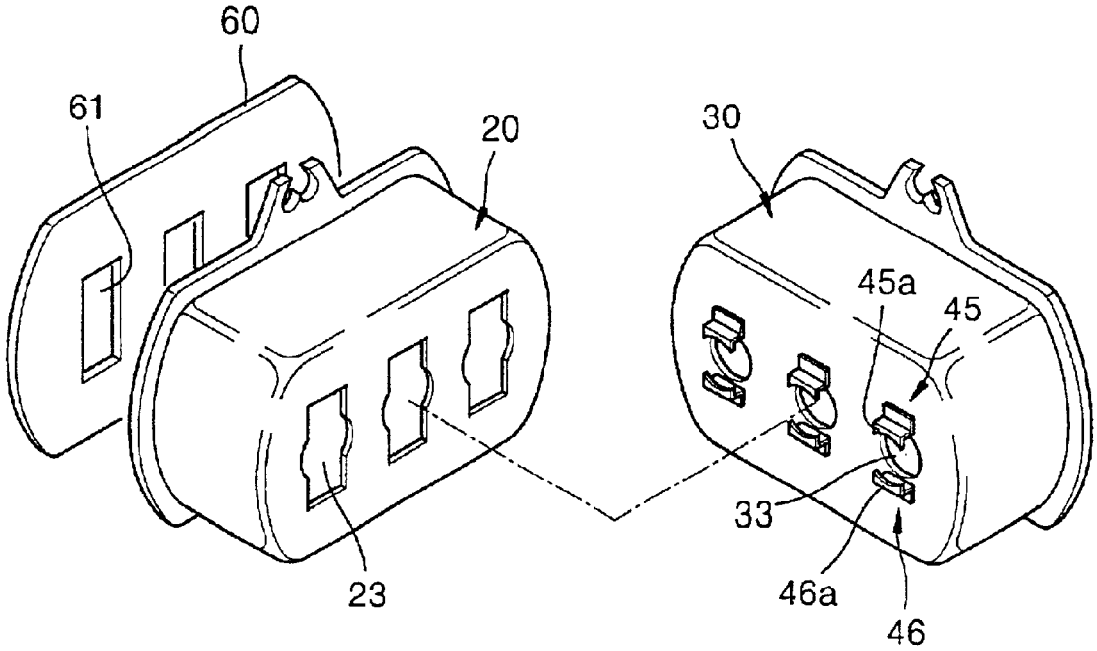
FIG. 6 is a perspective view showing a first focusing electrode and a second focusing electrode, which are separated, according to a third preferred embodiment of the present invention.
Figure 7:
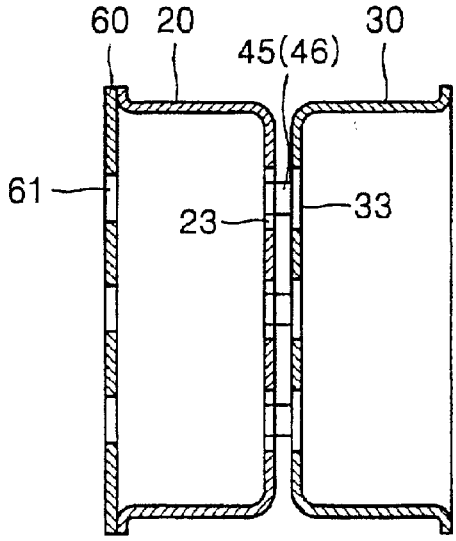
FIG. 7 is a sectional view showing the state in which the first and second focusing electrodes shown in FIG. 6 are combined.

FIGS. 6 and 7 shows a correction unit for varying focusing and diverging forces of a quadrupole lens according to third preferred embodiment of the present invention. Referring to the drawings, vertically elongated electron beam passing holes 23 are formed in the first focusing electrode 20 while circular electron beam passing holes 33 are formed in the second focusing electrode 30. Fifth and sixth protruding portions 45 and 46 are formed in the vertical direction at the upper and lower sides of each of the circular electron beam passing holes 33. The fifth and sixth protruding portions 45 and 46 are inserted into the vertically elongated electron beam passing hole 23 of the first focusing electrode 20 so that the flat surfaces 45*a* and 46*a* of the fifth and sixth protruding portions 45 and 46 are disposed parallel to the same plane as the surface of the first focusing electrode 20 where the electron beam passing holes 23 are formed. Here, to improve the effect of the quadrupole lens, a plate electrode member 60 may be installed inside of the first focusing electrode 20, where the vertically elongated electron beam passing holes 61 are formed.

Figure 8:
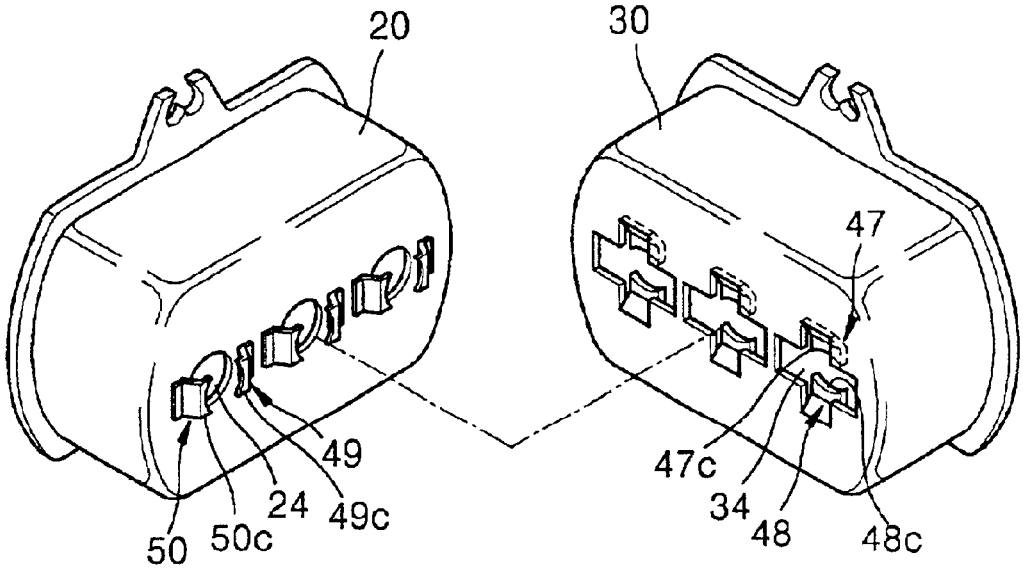
FIG. 8 is a perspective view showing a first focusing electrode and a second focusing electrode, which are separated, according to a fourth preferred embodiment of the present invention.
Figure 9:
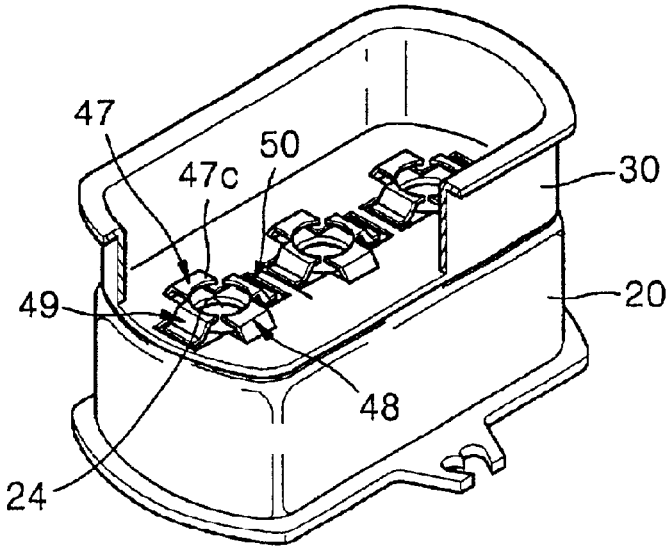
FIG. 9 is a partially cut-away perspective view showing the state in which the first and second focusing electrodes shown in FIG. 8 are combined.

FIGS. 8 and 9 show a correction unit according to a fourth preferred embodiment of the present invention. Referring to the drawing, circular electron beam passing holes 24 are formed in the first focusing electrodes 20 while horizontally elongated electron beam passing holes 34 are formed in the second focusing electrode 30. Seventh and eighth protruding portions 47 and 48 are formed inside the second focusing electrode 30 at the upper and lower sides of each of the horizontally elongated electron beam passing holes 34 of the second focusing electrode 30 in the vertical direction. Ninth and tenth protruding portions 49 and 50 installed at the left and right sides of each of the circular electron beam passing holes 24 of the first focusing electrode 20 in the horizontal direction and inserted into the horizontally elongated electron beam passing holes 34 of the second focusing electrode 30. Flat surfaces 47*c* and 48*c* of the seventh and eighth protruding portions 47 and 48 and flat surfaces 49 and 50*c* of the ninth and tenth protruding portions 49 and 50 are disposed inside the second focusing electrode 30. The seventh and eighth protruding portions 47 and 48 of the second focusing electrode 30 may be formed integrally with the second focusing electrode 30 by cutting the edge of the electron beam passing hole (or in a lancing process).

Figure 10:
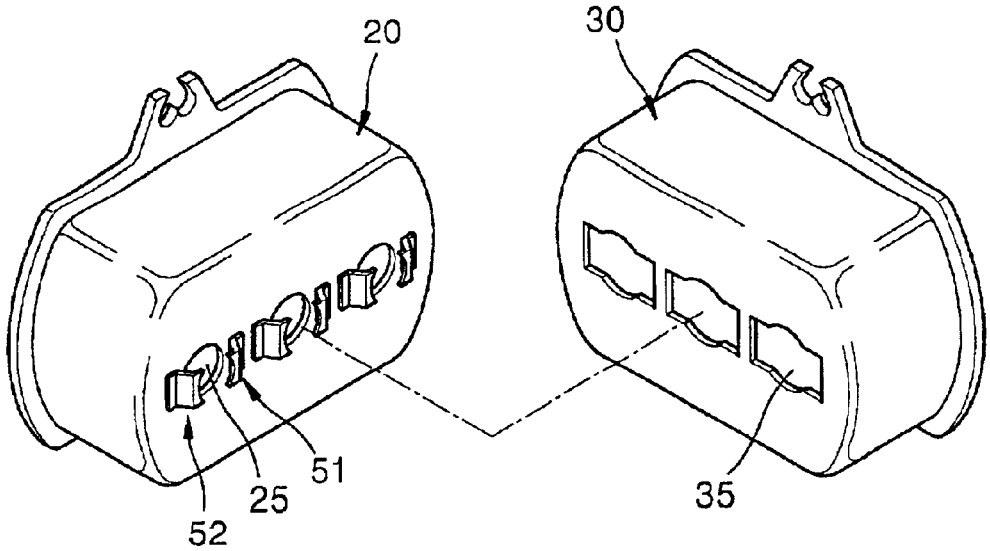
FIG. 10 is a perspective view showing a first focusing electrode and a second focusing electrode, which are separated, according to a fifth preferred embodiment of the present invention.
Figure 11:
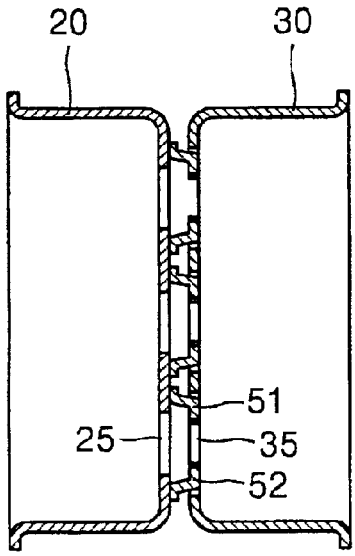
FIG. 11 is a sectional view showing the state in which the first and second focusing electrodes shown in FIG. 10 are combined.

FIGS. 10 and 11 show a correction unit according to a fifth preferred embodiment of the present invention. As shown in the drawings, circular electron beam passing holes 25 are formed in the first focusing electrode 20 while horizontally elongated electron beam passing holes 35 are formed in the second focusing electrode 30. Eleventh and twelfth protruding portions 51 and 52 are installed at the left and right sides of each of the circular electron beam passing holes 25 of the first focusing electrode 20 in the horizontal direction and inserted into the horizontally elongated electron beam passing holes 35 of the second focusing electrode 30.

Figure 12:
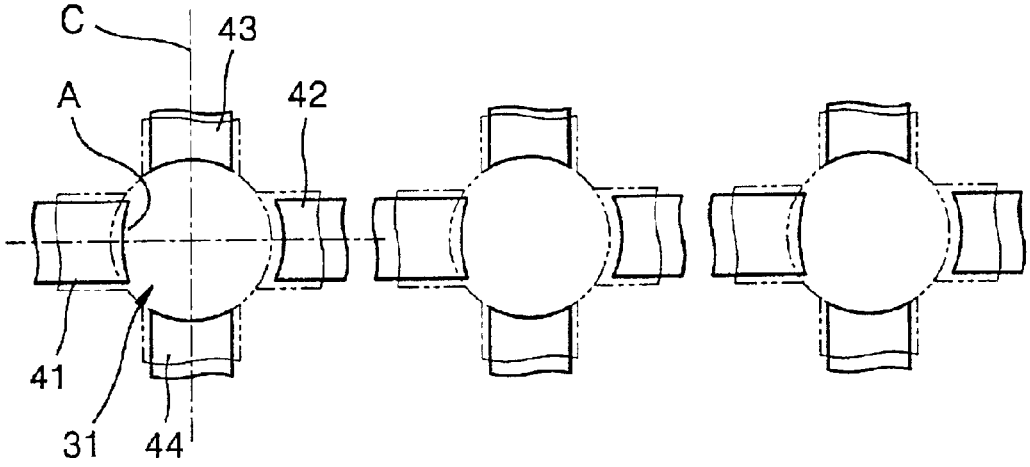
FIG. 12 is a view showing the state in which an electron beam passing area formed by the protruding portion is formed.

In the above-described preferred embodiments, as shown in FIG. 12, an electron beam passing area A formed by the flat surfaces of the protruding portions 41 through 44 formed at the edge of the three electron beam passing holes arranged inline preferably formed asymmetrically to the left and right with respective to a vertical axis c passing the center of the electron beam passing holes 21 and 31 of the first or second focusing electrode 20 or 30, thus forming an asymmetrical lens.

The eleventh and twelfth protruding portions 51 and 52 may be formed integrally with the first focusing electrode 20 by applying a lancing process to the edge in the horizontal direction of each circular electron beam passing hole 25.

A predetermined voltage is applied to each of the electrodes of the electron gun having the above structure. That is, a constant voltage VS is applied to the screen electrode 13 and the second auxiliary focusing electrode 15. A focus voltage VF higher than the constant voltage VS is applied to the first focusing electrode 20. A parabola type dynamic focus voltage that increases in synchronism with a deflection signal as a beam deviates toward the peripheral portion of a screen, is applied to the second focusing electrode 30, and an anode voltage higher than the voltage is applied to the final focusing electrode 16.

The operation of an electron gun for a color CRT having the above structure according to the present invention is described as follows.

First, as predetermined electric potential are applied to the electrodes shown in FIG. 2 which forms an electron gun for a color CRT, an electron lens is formed between the respective electrodes by means of the line of electric force and the equipotential line. The formation of an electron lens is described below depending on the cases in which an electron beam is scanned onto the central portion or the peripheral portion of a fluorescent film.

When the electron beam is scanned onto the central portion of a fluorescent film, since a quadrupole lens is not formed by the first and second focusing electrodes 20 and 30, the electron beam emitted from the cathode 11 is preliminarily focused and accelerated by a pre-focus lens formed at the screen electrode 13 and the first auxiliary focusing electrode 14 and an auxiliary lens formed by the first and second auxiliary focusing electrodes 14 and 15. Then, the electron beam is finally focused and accelerated by the main lens formed between the second focusing lens 30 and the final focusing electrode 16 and lands on the central portion of the fluorescent film.

When the electron beam emitted from the electron gun is scanned onto the peripheral portion of the fluorescent film of a CRT, a dynamic voltage in synchronism with a deflection signal is applied to the second focusing electrode 30 and a relatively low dynamic focus voltage is applied to the first focusing electrode 20 so that a dynamic quadrupole lens is formed therebetween. As the dynamic voltage is applied between the second focusing electrode 30 and the final focusing electrode 16, a large diametric main lens having a relatively low magnifying power is formed.

In the above state in which the main lens is formed, the electron beam emitted from the cathodes 11 is preliminarily focused and accelerated while passing through the pre-focus lens and auxiliary lens and then passes through the quadrupole lens. Since the first, second, third, and fourth protruding portions 41, 42, 43, and 44 in which the corresponding end portions of the flat surfaces 41*c*, 42*c*, 43*c*, and 44*c* have the shape of the electron beam passing hole are formed on the opposite surfaces of the first and second focusing electrodes 20 and 30, as shown in FIGS. 2 and 3, a strong quadrupole lens is formed.

Thus, the vertical divergent electric field of the quadrupole lens increases, the correction function of making the profile of the electron beam vertically elongate becomes stronger than the correction function of the quadrupole lens through which the central electron beam passes. In detail, as the difference between the vertical component and the horizontal component of the electric field forming the quadrupole lens increases, distortion of the electric field increases and the quadrupole lens becomes strong.

In the above description, the vertical elongation of the electron beam becomes serious due to the correction function so that the distortion of the electron beam due to the non-uniform magnetic field of the main lens and the deflection yoke is corrected. Further, uniform electron beam spots are made throughout the entire fluorescent film. In this process, a dynamic focus voltage is applied to the second focusing electrode 30 and the difference of a voltage from the final focusing electrode 16 decreases. Thus, as the magnification of the main lens is lowered, the electron beam passing through the main lens has spherical aberration and the focal length of the electron beam increases.

Meanwhile, the effect of the quadrupole lens formed between the first and second focusing electrodes according to the above-described other preferred embodiments is strengthened so that astigmatism of the electron beam can be improved.

As described above, in the electron gun for a color CRT according to the present invention, when each electron beam of which the profile is changed by a condensing/diverging force by means of the quadrupole lenses is deflected by the non-uniform magnetic filed of the deflection yoke, the horizontal diameter of the electron beam can be prevented from being magnified and the beam is prevented from being distorted. Further, a uniform focus feature can be obtained at the central portion and the peripheral portion of a screen.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An electron gun for a color cathode-ray tube, comprising:

a triode unit emitting an electron beam, said triode unit including a cathode, a control electrode, and a screen electrode; and first and second focusing electrodes, installed coaxially with said triode unit, for forming at least one quadrupole lens, protruding portions including flat surfaces corresponding to opposite surfaces of said first and second focusing electrodes are formed on at least one of the opposite surfaces of said first and second focusing electrodes to change the profile of the electron beam by applying a dynamic focus voltage to the edge of electron beam passing holes formed in the opposite surfaces, wherein vertically elongated electron beam passing holes are formed in said first focusing electrode and horizontally elongated electron beam passing holes are formed in said second focusing electrode, first and second protruding portions are formed at the horizontally opposite sides of each of the vertically elongated electron beam passing holes, and third and fourth protruding portions are formed at the vertically opposite sides of each of the horizontally elongated electron beam passing holes, and first and second flat surfaces are formed at said first and second protruding portions, respectively, and third and fourth flat surfaces are formed at said third and fourth protruding portions, respectively, accommodating a formation of a quadruple lens for changing the profile of an electron beam when a dynamic focus voltage is applied.

2. The electron gun as claimed in claim 1, wherein the shape of an end portion of each of said first, second, third, and fourth protruding portions is any one of circular, oval, and polygonal.

3. The electron gun as claimed in claim 1, wherein the shape of at least one of the electron beam passing holes is circular.

4. The electron gun as claimed in claim 3, further comprising of a plate electrode member in which vertically elongated electron beam passing holes are formed is installed inside said first focusing electrode.

5. The electron gun as claimed in claim 1, with end portions of the protruding portions including a portion of the shape of the electron beam passing holes formed in the opposite surfaces of the first and second focusing electrodes.

6. An electron gun for a color cathode-ray tube, comprising:

a triode unit emitting an electron beam, said triode unit including a cathode, a control electrode, and a screen electrode; and first and second focusing electrodes, installed coaxially with said triode unit, for forming at least one quadrupole lens, protruding portions including flat surfaces corresponding to opposite surfaces of said first and second focusing electrodes are formed on at least one of the opposite surfaces of said first and second focusing electrodes to change the profile of the electron beam by applying a dynamic focus voltage to the edge of electron beam passing holes formed in the opposite surfaces, wherein an electron beam passing area formed by protruding portions formed at the edge of each of the electron beam passing holes disposed at the sides of among three electron beam passing holes forms an asymmetrical lens to the left and right with respect to a vertical axis passing through the center of each of the electron beam passing holes disposed at the sides to focus three electron beams.

7. An electron gun for a color cathode-ray tube, comprising:

a triode unit emitting an electron beam, said triode unit including a cathode, a control electrode, and a screen electrode; and first and second focusing electrodes, installed coaxially with said triode unit for forming at least one quadrupole lens, protruding portions including flat surfaces corresponding to opposite surfaces of said first and second focusing electrodes are farmed on at least one of the opposite surfaces of said first and second focusing electrodes to change the profile of the electron beam by applying a dynamic focus voltage to the edge of electron beam passing holes formed in the opposite surfaces, wherein vertically elongated electron beam passing holes are formed in said first focusing electrode and circular electron beam passing holes are formed in said second focusing electrode, and fifth and sixth protruding portions are formed in a vertical direction at the upper and lower sides of each of the circular electron beam passing holes of said second focusing electrode to be inserted into the vertically elongated electron beam passing holes of said first focusing electrode.

8. An electron gun for a color cathode-ray tube, comprising:

a triode unit emitting an electron beam, said triode unit including a cathode, a control electrode, and a screen electrode; and first and second focusing electrodes, installed coaxially with said triode unit for forming at least one quadrupole lens, protruding portions including flat surfaces corresponding to opposite surfaces of said first and second focusing electrodes are formed on at least one of the opposite surfaces of said first and second focusing electrodes to change the profile of the electron beam by applying a dynamic focus voltage to the edge of electron beam passing holes formed in the opposite surfaces, wherein the circular electron beam passing holes are formed in said first focusing electrode and horizontally elongated electron beam passing holes, seventh and eighth protruding portions formed inside said second focusing electrode in the vertical direction at the upper and lower sides of each of the horizontally elongated electron beam passing holes of said second focusing electrode, ninth and tenth protruding portions are installed at the left and right sides of each of the circular electron beam passing holes of said first focusing electrode to be inserted into the horizontally elongated electron beam passing holes, and flat surfaces of said seventh and eighth protruding portions and flat surfaces of said ninth and tenth protruding portions are disposed inside said second focusing electrode.

9. The electron gun as claimed in claim 8, wherein said seventh and eighth protruding portions are integrally formed with said second focusing electrode by applying a lancing process to the edge of the electron beam passing holes.

10. An electron gun for a color cathode-ray tube, comprising:

a triode unit emitting an electron beam, said triode unit including a cathode, a control electrode, and a screen electrode; and first and second focusing electrodes, installed coaxially with said triode unit, for forming at least one quadrupole lens, protruding portions including flat surfaces corresponding to opposite surfaces of said first and second focusing electrodes are formed on at least one of the opposite surfaces of said first and second focusing electrodes to change the profile of the electron beam by applying a dynamic focus voltage to the edge of electron beam passing holes formed in the opposite surfaces, wherein the circular electron beam passing holes are formed in said first focusing electrode and the horizontally elongated electron beam passing holes are formed in said second focusing electrode, and eleventh and twelfth protruding portions are installed in the horizontal direction at the left and right sides of each of the circular electron beam passing holes of said first focusing electrode to be inserted into the horizontally elongated electron beam passing holes of said second focusing electrode.

11. The electron gun as claimed in claim 10, wherein said eleventh and twelfth protruding portions are integrally farmed with said first focusing electrode by applying a lancing process to the edge in the horizontal direction of the circular electron beam passing holes of said first focusing electrode.

12. An electron gun for a color cathode-ray tube, comprising:

a triode unit emitting an electron beam, said triode unit including a cathode, a control electrode, and a screen electrode;

first and second auxiliary focusing electrodes sequentially installed coaxially with said triode unit, for forming auxiliary lenses;

first and second focusing electrodes installed coaxially with said first and second auxiliary focusing electrodes, for forming a quadrupole lens, protruding portions having flat surfaces corresponding to opposite surfaces of said first and second focusing electrodes are formed on at least one of the opposite surfaces of said first and second focusing electrodes to change the profile of the electron beam by applying a dynamic focus voltage to the edge of electron beam passing holes formed in the opposite surfaces; and a final acceleration electrode installed adjacent to said second focusing electrode, for forming a main lens.

13. The electron gun as claimed in claim 12, wherein vertically elongated electron beam passing holes are formed in said first focusing electrode and horizontally elongated electron beam passing boles are formed in said second focusing electrode, first and second protruding portions are formed in a horizontal direction at the left and right sides of each of the vertically elongated electron beam passing holes and third and fourth protruding portions are formed in a vertical direction at the upper and lower side of each of the horizontally elongated electron beam passing holes, and first and second flat surfaces of said first and second protruding portions, respectively, and third and fourth flat surfaces of said third and fourth protruding portions, respectively, are disposed on the same plane.

14. The electron gun as claimed in claim 12, wherein the shape of an end portion of each of said protruding portions is any one of circular, oval, and polygonal arc.

15. The electron gun for a color cathode-ray tube of claim 12, with the flat surfaces being fanned at an end portion of the protruding portion sad the flat surfaces being parallel with the opposite surfaces of the first and second focusing electrodes having the beam passing holes.

16. An electron gun for a color cathode-ray tube, comprising:

a triode unit emitting an electron beam, said triode unit including a cathode, a control electrode, and a screen electrode;

first and second focusing electrodes installed coaxially with said triode unit, for forming a quadrupole lens; and protruding portions including flat surfaces inclined at a predetermined angle with respect to opposite surfaces of said first and second focusing electrodes, for changing the profile of the electron beam when a dynamic focus voltage is applied to the edge of electron beam passing holes formed in each of the opposite surfaces of said first and second focusing electrodes, wherein protruding portions formed at the edges in the vertical direction or the horizontal direction of the electron beam passing holes formed in said first focusing electrode facing said second focusing electrode are formed by cutting said first focusing electrode to be integral with said first focusing electrode.

17. An electron gun for a color cathode-ray tube, comprising:

a triode unit emitting an electron beam, said triode unit including a cathode, a control electrode, and a screen electrode;

first and second focusing electrodes installed coaxially with said triode unit, for forming a quadrupole lens; and protruding portions including flat surfaces inclined at a predetermined angle with respect to opposite surfaces of said first and second focusing electrodes, for changing the profile of the electron beam when a dynamic focus voltage is applied to the edge of electron beam passing holes formed in each of the opposite surfaces of said first and second focusing electrodes, wherein protruding portions formed at the edges in the vertical direction or the horizontal direction of the electron beam passing boles formed in said second focusing electrode facing said first focusing electrode are formed by cutting said second focusing electrode to be integral with said second focusing electrode.

18. An electron gun for a color cathode-ray tube, comprising:

a triode unit emitting an electron beam, said triode unit including a cathode, a control electrode, and a screen electrode;

first and second focusing electrodes installed coaxially with said triode unit, for forming a quadrupole lens; and protruding portions including flat surfaces inclined at a predetermined angle with respect to opposite surfaces of said first and second focusing electrodes, for changing the profile of the electron beam when a dynamic focus voltage is applied to the edge of electron beam passing holes formed in each of the opposite surfaces of said first and second focusing electrodes, wherein protruding portions are formed at the edges in the vertical direction or the horizontal direction of the three electron beam passing holes arranged inline with at least one of the surfaces of said first and second focusing electrodes facing each other, accommodating the forming of a quadruple lens, and an electron beam passing area formed by protruding portions formed at the edge of each of the electron beam passing holes disposed at the sides of among three electron beam passing holes forms an asymmetrical lens to the left and right with respect to a vertical axis passing through the center of each of the electron beam passing holes disposed at the sides to focus three electron beams.

19. An electron gun for a color cathode-ray tube, comprising:

a triode unit emitting an electron beam, said triode unit including a cathode, a control electrode, and a screen electrode; and first and second focusing electrodes, installed coaxially with said triode unit, for forming at least one quadrupole lens, protruding portions including flat surfaces corresponding to opposite surfaces of said first and second focusing electrodes are formed on at least one of the opposite surfaces of said first and second focusing electrodes to change the profile of the electron beam by applying a dynamic focus voltage to the edge of electron beam passing holes formed in the opposite surfaces, with one of the protruding portions comprising:

a first portion of the protruding portion forming abase with a corresponding surface of one of the first focusing electrode and the second focusing electrode;

a second portion of the protruding portion extending from the first portion through a bend; and a third portion of the protruding portion being bent toward the respective electron beam passing holes from the second portion and parallel to the opposite surfaces of the first and second focusing electrodes.

* * * * *